US005771002A

United States Patent [19]

Creek et al.

[11] Patent Number: 5,771,002

[45] Date of Patent: Jun. 23, 1998

[54] TRACKING SYSTEM USING RADIO FREQUENCY SIGNALS

[75] Inventors: William R. Creek, Fremont; Marvin L. Wahl, Sunnyvale; Bryan L. Clausen, Sr.; Mery Clausen, both of San Jose; Bryan Clausen, Jr., Menlo Park, all of Calif.

[73] Assignee: The Board of Trustees of the Leland Stanford Junior University, Palo Alto, Calif.

[21] Appl. No.: 822,111

[22] Filed: Mar. 21, 1997

[51] Int. Cl.[6] ..... G08B 1/08

[52] U.S. Cl. ..... 340/539; 340/573; 455/100; 455/49.1

[58] Field of Search ..... 340/539, 571, 340/572, 573, 825.36, 825.49; 455/49.1, 53.1, 67.7, 88–90, 100

[56] References Cited

U.S. PATENT DOCUMENTS

| | | | |
|---|---|---|---|
| 4,598,272 | 7/1986 | Cox | 340/539 |
| 4,777,478 | 10/1988 | Hirsch et al. | 340/573 |
| 4,785,291 | 11/1988 | Hawthorne | 340/573 |
| 4,899,135 | 2/1990 | Ghahariiran | 340/573 |
| 4,973,944 | 11/1990 | Maletta | 340/568 |
| 5,119,072 | 6/1992 | Hemingway | 340/573 |
| 5,289,163 | 2/1994 | Perez et al. | 340/539 |
| 5,298,883 | 3/1994 | Pilney et al. | 340/573 |
| 5,525,967 | 6/1996 | Azizi et al. | 340/573 |
| 5,652,569 | 7/1997 | Gerstenberger et al. | 340/573 |
| 5,661,460 | 8/1997 | Sallen et al. | 340/573 |

OTHER PUBLICATIONS

Webb, W.; Church, R.;Pittman, W. Jr.;Boyle, J. Jr. *A Short–Range Locator System for Detecting Trapped Miners*, Bureau of Mines Investigation Report 8844. Pgh., PA. pp. 1–22.

*Primary Examiner*—Jeffery A. Hofsass
*Assistant Examiner*—Daryl C. Pope
*Attorney, Agent, or Firm*—Lumen Intellectual Property Services

[57] ABSTRACT

A tracking system comprising multiple satellite units and a master unit for selectively and individually locating each satellite unit. Each satellite unit receives a search signal from the master unit and transmits a response signal to the master unit when the search signal contains a search identity code which matches a unique identity code of the satellite unit. The master unit has user controls for selecting any one of the satellite units to be located and a memory for storing the unique identity code of each satellite unit. The master unit also has an indicator circuit for indicating the strength of the response signal and a display and speaker for visually and audibly indicating the strength to a user. The master unit is programmed such that when the user selects one of satellite units to be located, the master unit transmits a search signal having a search identity code which matches the unique identity code of the selected satellite unit. The tracking system also preferably includes a passive re-radiating strip to be attached to an object to be tracked. The strip receives signals from the master unit at a fundamental frequency and re-radiates the signals at a multiple of the fundamental frequency. The master unit indicates the strength of the re-radiated signals to the user, enabling the user to locate the strip.

31 Claims, 4 Drawing Sheets

TRACKING SYSTEM USING RADIO FREQUENCY SIGNALS

FIELD OF THE INVENTION

The present invention relates generally to tracking systems, and in particular to a tracking system having a master unit and multiple satellite units or re-radiating strips which communicate with the master unit through radio frequency signals.

DESCRIPTION OF PRIOR ART

Numerous systems have been developed to monitor the location of individuals, pets, or objects. Such monitoring systems are disclosed in the following U.S. Pat. No. 4,598,272 issued to Cox on Jul. 1, 1986; U.S. Pat. No. 4,777,478 issued to Hirsch et al. on Oct. 11, 1988; U.S. Pat. No. 4,785,291 issued to Hawthorne on Nov. 15, 1988; U.S. Pat. No. 4,899,135 issued to Ghahariiran on Feb. 6, 30, 1990; U.S. Pat. No. 4,973,944 issued to Maletta on Nov. 27, 1990; U.S. Pat. No. 5,119,072 issued to Hemingway on Jun. 2, 1992; U.S. Pat. No. 5,298,883 issued to Pilney et al. on Mar. 29, 1994; and U.S. Pat. No. 5,289,163 issued to Perez et al. on Feb. 22, 1994.

Each of the disclosed monitoring systems includes a transmitting unit which is attached to the individual to be monitored. The transmitting unit emits a radio signal which is detected by a receiving unit. By monitoring the strength of the received signal, the receiving unit determines the direction and distance to the transmitting unit, thereby tracking the individual. Various alarm systems are generally included in the transmitting and receiving units for activating an alarm when a threshold distance between the units is exceeded.

One disadvantage of these conventional monitoring systems is that the transmitting unit must send a constant signal which is continuously monitored by the receiving unit. This constant transmission and reception of signals places a relatively high drain on the power sources of both the transmitting and receiving units. Another disadvantage in conventional radio frequency systems is that the receiving unit is easily confused when more than one transmitting unit is used, e.g. when a user wishes to track multiple individuals, pets, or objects. If two transmitting units are operating at the same frequency, the signals of the transmitting units interfere with each other. This problem may be solved by causing the transmitters to broadcast at different frequencies. However, this solution becomes unworkable as the number of transmitting units is increased.

Another method for receiving signals from multiple transmitting units involves assigning each transmitting unit a unique digital code for transmission. The receiving unit distinguishes between various transmitting units by identifying the digital code. However, with a large number of constantly transmitting units, a typical receiving unit quickly becomes overwhelmed and is unable to determine which transmitting unit initiated a given signal. Thus, a digital coding method typically requires a very complex, and hence expensive, receiving unit to differentiate multiple signals.

OBJECTS AND ADVANTAGES OF THE INVENTION

In view of the above, it is a primary object of the present invention to provide a reliable and inexpensive tracking system which includes a master unit and multiple satellite units, wherein any one of the satellite units may be selectively and individually located by the master unit. It is another object of the invention to provide such a tracking system in which the satellite units may function in close proximity to each other without producing signal interference. Another object of the invention is to provide a tracking system which reduces the amount of power required to operate the master and satellite units. A further object of the invention is to provide a tracking system which includes a number of small and inexpensive re-radiating strips which may be substituted for the satellite units for close proximity applications.

These and other objects and advantages will become more apparent after consideration of the ensuing description and the accompanying drawings.

SUMMARY

The invention presents a tracking system comprising at least one satellite unit and a master unit for selectively and individually locating the satellite unit. In the preferred embodiment, the tracking system includes up to six satellite units, any one of which may be selectively and individually located by the master unit. Each satellite unit preferably includes a fastener, such as a belt or strap, for securing the satellite unit to an individual, pet, or object to be located.

Each satellite unit includes a non-volatile memory for storing a unique identity code of the satellite unit. Each satellite unit also includes an omni-directional antenna, a receiver connected to the antenna for receiving coded radio frequency search signals from the master unit, and a transmitter connected to the antenna for transmitting coded radio frequency response signals to the master unit. Each search signal includes a search identity code and each response signal includes the unique identity code of the satellite unit which transmitted the response signal.

Each satellite unit further includes a microcontroller connected to its memory, receiver, and transmitter. The microcontroller is programmed to decode the search signal and determine whether the search identity code matches the unique identity code of the satellite unit. The microcontroller is also programmed to control the operation of the transmitter such that the transmitter transmits a response signal to the master unit when the search identity code matches the unique identity code of the satellite unit.

The master unit has user controls, such as buttons or switches, for individually selecting any one of the satellite units to be located. The master unit also has a directional antenna. A first transmitter is connected to the directional antenna for transmitting the search signals to the satellite units. A receiver is also connected to the directional antenna for receiving the response signals from the satellite units. The receiver includes a received signal strength indicator circuit for determining the strength of the response signals.

The master unit further has a microcontroller connected to the user controls, first transmitter, and receiver. The microcontroller has a memory for storing the unique identity code of each satellite unit. The microcontroller is programmed to control the first transmitter such that when a user of the master unit selects one of the satellite units to be located, the first transmitter transmits a search signal with a search identity code matching the unique identity code of the selected satellite unit. The master unit further includes a display and a speaker which are connected to the signal strength indicator circuit through the microcontroller for visually and audibly indicating to the user the strength of the response signal received from the selected satellite unit.

In the preferred embodiment, the tracking system further comprises at least one re-radiating strip for re-radiating a third radio frequency signal received from the master unit. In this embodiment, the user controls also include a strip control, such as a button, for instructing the master unit to transmit the third signal. The master unit further includes an omni-directional antenna and a second transmitter connected to the omni-directional antenna and the microcontroller for transmitting the third signal to the re-radiating strip.

Also in this embodiment, the receiver of the master unit is designed to receive the re-radiated signal from the strip through the directional antenna. The received signal strength indicator circuit is also designed to determine a strength of the re-radiated signal. The microcontroller of the master unit is programmed to control the second transmitter such that when the user activates the strip control, the second transmitter transmits the third signal to the strip. The display and speaker of the master unit visually and audibly indicate to the user the strength of the re-radiated signal.

DETAILED DESCRIPTION

Figure 1:
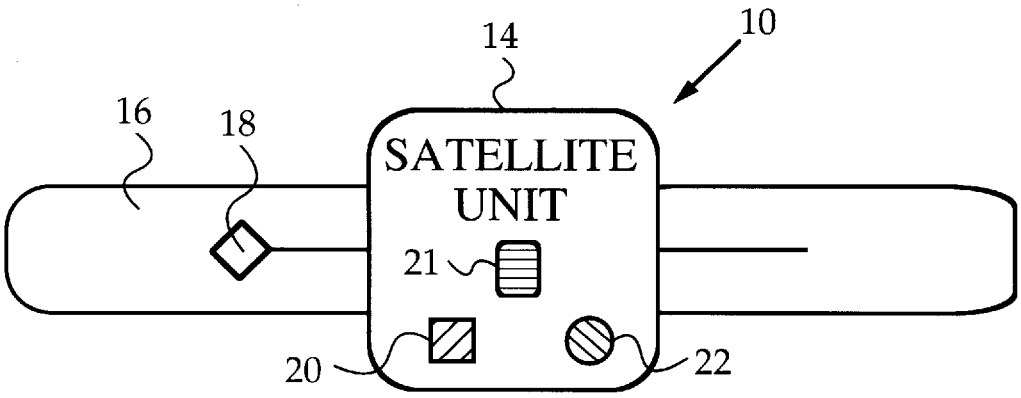
FIG. 1 is a top plan view of a satellite unit according to the invention.

The present invention is a radio frequency tracking system which includes multiple satellite units and a master unit for selectively and individually locating any one of the satellite units. The tracking system also preferably includes at least one re-radiating strip to be located by the master unit. A preferred embodiment of the tracking system is illustrated in FIGS. 1–11. Referring to FIG. 1, a satellite unit 10 includes a housing 14 which is preferably water resistant. Housing 14 is sufficiently compact to be unobtrusively worn on a belt, collar, or wrist of a wearer.

In the preferred embodiment, housing 14 is a plastic housing having a length of 5.0 cm, a width of 2.5 cm, and a thickness of 1.0 cm. A fastener, such as a strap 16, is attached to housing 14 for securing satellite unit 10 to the belt, collar or wrist of the wearer. Satellite unit 10 also includes an antenna 18 which is preferably integrated with strap 16. In the preferred embodiment, antenna 18 is attached to an outer surface of strap 16. In an alternative embodiment, antenna 18 is sewn into strap 16.

A response button 20 is located on a top surface of housing 14. Satellite unit 10 also includes an audio transducer, such as a speaker 21, and a visual indicator, such as a light emitting diode (LED) 22. Speaker 21 and LED 22 are for audibly and visually alerting the wearer of unit 10 that he or she is being searched for by the master unit. Response button 20 is pressed by the wearer to acknowledge the search.

Figure 2:
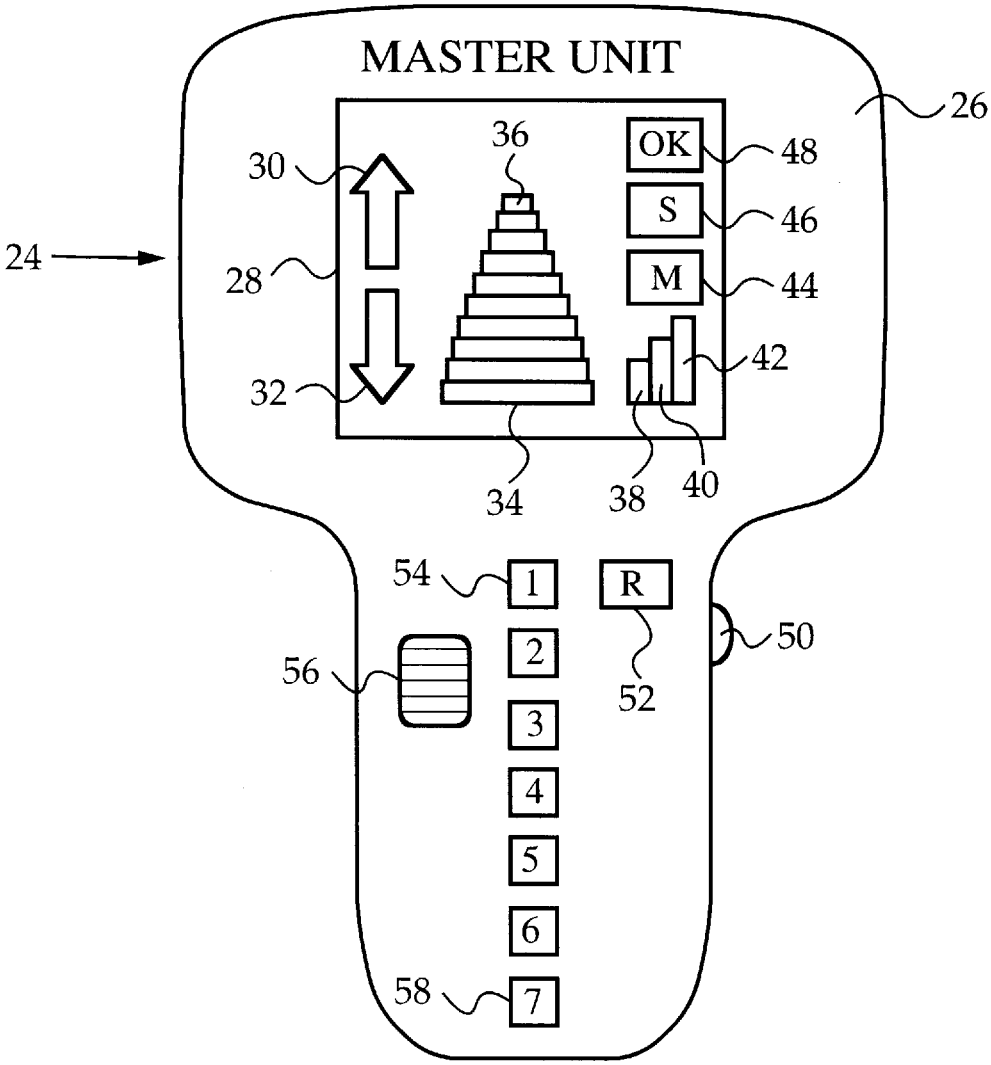
FIG. 2 is a top plan view of a master unit according to the invention.

Referring to FIG. 2, a master unit 24 includes a housing 26 which is preferably water resistant. Housing 26 is sufficiently compact to be hand-held and carried by a user of the master unit. In the preferred embodiment, housing 26 is a plastic housing having a length of 18.0 cm, an upper width of 12.7 cm, a lower width of 6.5 cm, and a thickness of 2.0 cm. Master unit 24 also includes a display 28 which is preferably a liquid crystal display (LCD).

Display 28 includes display symbols for indicating to the user various operating statuses of the master and satellite units. The display symbols include an up arrow 30 for indicating that master unit 24 is transmitting a search signal to the satellite unit and a down arrow 32 for indicating that master unit 24 is receiving a response signal from the satellite unit. The display symbols also include a bar graph 34 having ten individually lightable bars 36 for visually indicating to the user the strength of the response signal received from the satellite unit.

Three range control symbols are located adjacent bar graph 34. The range control symbols are for indicating to the user an effective resolution range currently selected, as will be explained in the operation section below. The range control symbols include a short range symbol 38, a default mid-range symbol 40, and a long range symbol 42. The display symbols further include a master unit battery status symbol 44, a satellite unit battery status symbol 46, and a response button symbol 48. Symbols 44 and 46 are for indicating a low voltage status of the power supplies of the master unit and satellite unit, respectively. Symbol 48 is for indicating to the user that the wearer of the satellite unit has pushed the response button.

Master unit 24 also includes user controls for controlling the operation of the master unit. The user controls include six satellite select buttons 54, numbered 1–6 in FIG. 2, for individually selecting any one of the satellite units to be located by the master unit. Each satellite select button corresponds to an individual satellite unit, so that up to six satellite units may be simultaneously employed in the preferred embodiment. Each satellite select button is preferably distinctly numbered and color coded to facilitate user selection of a satellite unit to be located.

The user controls also include a re-radiating strip select button 58 for instructing the master unit to locate a re-radiating strip. The user controls further include an on/off volume control switch 50 and a range control button 52. Range control button 52 is for selecting any one of the three effective resolution ranges of master unit 24. The three ranges include a long range to be utilized when the satellite unit is located far from the master unit, a default mid-range, and a short range to be utilized when the satellite unit is close to the master unit. Master unit 24 further includes an audio transducer, such as a speaker 56, for audibly indicating to the user the strength of the response signal received from the satellite unit.

In a preferred method of manufacturing the master and satellite units, each unit is assembled in a sandwich-like manner. Each unit has a top assembly which includes a top half of the unit's housing and a bottom assembly which includes a bottom half of the unit's housing. The top and bottom assemblies are attached to each other during final assembly of the unit. The bottom assembly of each unit houses a printed circuit board which has the electronic components of the unit printed thereon. Each unit also preferably includes a rubber gasket which forms a water resistant shield when the top and bottom assemblies of the unit are attached to each other.

Figure 3:
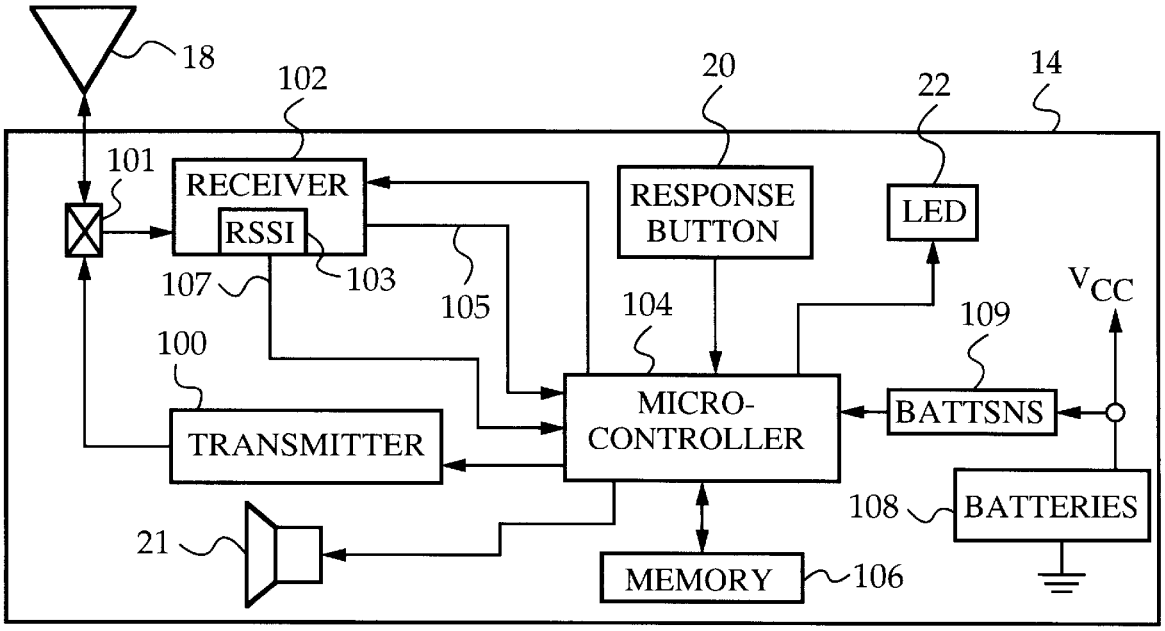
FIG. 3 is a schematic block diagram illustrating the components of the satellite unit of FIG. 1.

FIG. 3 is a schematic block diagram illustrating the components of the satellite unit. The satellite unit includes a memory 106 for storing a unique identity code of the satellite unit and a training sequence for synchronizing the satellite unit to the master unit. Memory 106 is preferably a non-volatile memory, such as an electrically erasable programmable read only memory (EEPROM). The satellite unit also includes antenna 18, a receiver 102 for receiving search signals from the master unit through antenna 18, and a transmitter 100 for transmitting response signals to the master unit through antenna 18. In the preferred embodiment, the search and response signals are digitally coded radio frequency signals and antenna 18 is an omni-directional antenna.

Receiver 102 is preferably a surface acoustic wave (SAW) based super regenerative receiver having a sensitivity of at least −105 dBm. In the preferred embodiment, receiver 102 is tuned to a frequency of 916.5 MHz. Receiver 102 has a first input connected to a transmit and receive (Tx-Rx) switch 101 and a data output 105 connected to a microcontroller 104. Receiver 102 also includes a received signal strength indicator (RSSI) circuit 103 for indicating the strength of received signals. A signal strength output 107 of RSSI circuit 103 is connected to microcontroller 104. Receiver 102 also includes a second input for receiving on/off signals from microcontroller 104.

RSSI circuit 103 is designed to determine the signal strength of received signals and output to microcontroller 104 an analog voltage signal indicative of the signal strength. In the preferred embodiment, receiver 102 is designed to receive signals whose signal strength ranges from −30 to −120 dBm. Circuit 103 is designed to output an analog voltage signal which varies linearly with the signal strength from a minimum value of 0.0V for a signal strength of −120 dBm to a maximum value of 3.0V for a signal strength of −30 dBm. Suitable receivers having RSSI circuits for performing this function are commercially available from National Semiconductor of Santa Clara, Calif.

Transmitter 100 is preferably a SAW oscillator with an amplitude modulation circuit. In the preferred embodiment, transmitter 100 is designed to transmit at a frequency of 905.8 MHz. The input of transmitter 100 is connected to microcontroller 104 and the output of transmitter 100 is connected to switch 101. Transmitter 100 and receiver 102 receive respective on/off control signals from microcontroller 104. Switch 101 is also under the control of microcontroller 104 for alternately connecting transmitter 100 and receiver 102 to antenna 18.

The satellite unit also includes a power supply, such as batteries 108, for supplying power to the electronic components of the satellite unit. Batteries 108 are preferably two size AA 1.5V batteries. A battery sensing circuit 109 for monitoring a voltage level of batteries 108 has an input connected to batteries 108 and an output connected to microcontroller 104. Response button 20, speaker 21, LED 22, and memory 106 are also connected to microcontroller 104.

Microcontroller 104 is programmed during manufacture to perform the control functions described in the operation section below. These control functions include driving speaker 21, polling the outputs of response button 20 and battery sensing circuit 109, and managing transmitter 100, switch 101, receiver 102, and LED 22. Microcontroller 104 is also programmed to encode and decode the search and response signals and to handle timing functions. Microcontroller 104 has two analog inputs and is capable of converting these analog inputs to digital values internally. The first analog input is the signal strength output 107 of RSSI circuit 103 and the second analog input is the voltage level output of battery sensing circuit 109.

Figure 4:
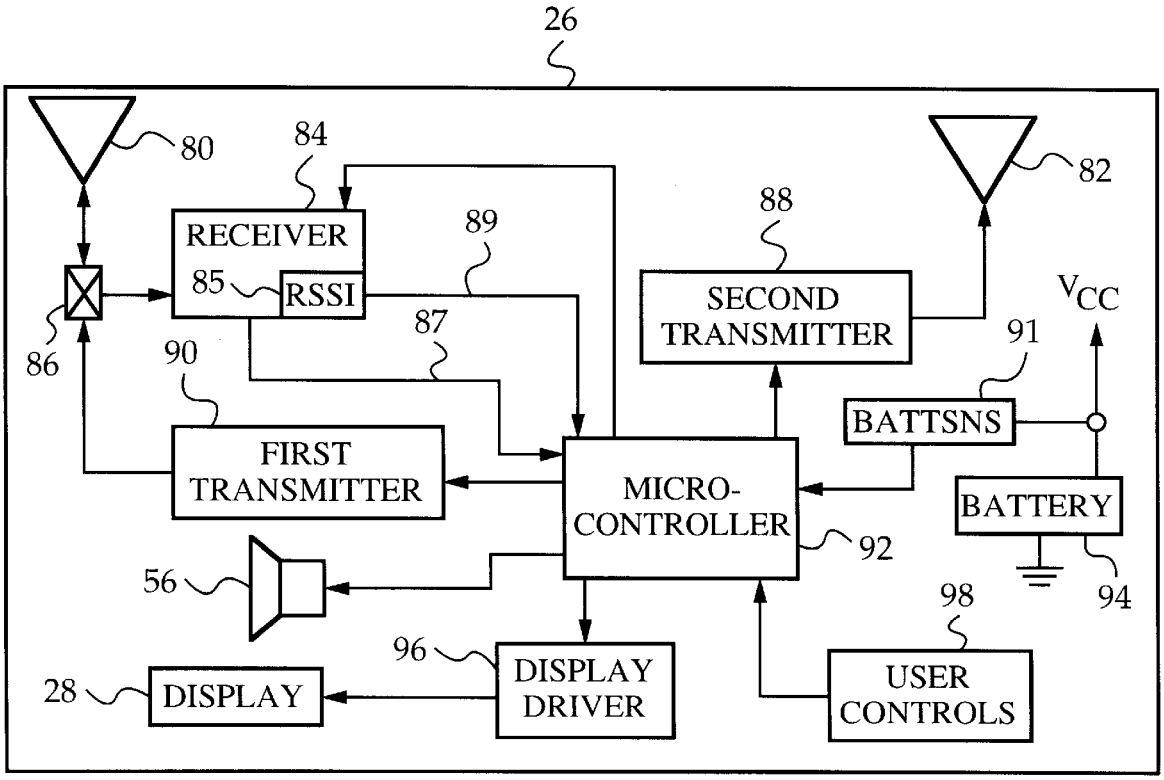
FIG. 4 is a schematic block diagram illustrating the components of the master unit of FIG. 2.

FIG. 4 is a schematic block diagram illustrating the components of the master unit. The master unit includes a directional antenna 80. Directional antenna 80 is preferably a multi-element Yagi-Uda antenna printed directly on the printed circuit board of the master unit. In the preferred embodiment, antenna 80 is tuned to a frequency of 910 MHz with a bandwidth of 20 MHz. The master unit also includes a receiver 84 for receiving the response signals from the satellite unit through directional antenna 80. Receiver 84 is preferably a SAW based super regenerative receiver having a sensitivity of at least −105 dBm.

In the preferred embodiment, receiver 84 is tuned to a frequency of 905.8 MHz. Receiver 84 has a first input connected to a Tx-Rx switch 86 and a data output 87 connected to a microcontroller 92. Receiver 84 also includes a RSSI circuit 85 for indicating a signal strength of received signals. A signal strength output 89 of RSSI circuit 85 is connected to microcontroller 92. Receiver 84 also includes a second input for receiving on/off signals from microcontroller 92. Directional antenna 80 is oriented in the master unit such that signals received by receiver 84 are strongest when the master unit is pointed directly at a signal source, e.g. the satellite unit or re-radiating strip.

RSSI circuit 85 is designed to determine the signal strength of received signals and output to microcontroller 92 an analog voltage signal indicative of the signal strength. In the preferred embodiment, receiver 84 is designed to receive signals whose signal strength ranges from −30 to −120 dBm. Circuit 85 is designed to output an analog voltage signal which varies linearly with the signal strength from a minimum value of 0.0V for a signal strength of −120 dBm to a maximum value of 3.0V for a signal strength of −30 dBm.

The master unit also includes a first transmitter 90 for transmitting the search signals to the satellite unit through antenna 80. Transmitter 90 is preferably a SAW oscillator with an amplitude modulation circuit. In the preferred embodiment, transmitter 90 is designed to transmit at a frequency of 916.5 MHz. The input of transmitter 90 is connected to microcontroller 92 and the output of transmitter 90 is connected to switch 86. Transmitter 90 and receiver 84 receive respective on/off control signals from microcontroller 92. Switch 86 is also under the control of microcontroller 92 for alternately connecting transmitter 90 and receiver 84 to antenna 80.

The master unit further includes a second antenna 82 which is preferably an omni-directional single element antenna tuned to 452.9 MHz. Both antennas 80 and 82 are preferably contained within housing 26 for ergonomic design of the master unit. A second transmitter 88 is connected to antenna 82 for transmitting radio frequency signals to a re-radiating strip through antenna 82. Transmitter 88 is preferably an unmodulated SAW based transmitter. In the preferred embodiment, transmitter 88 is designed to transmit unmodulated radio frequency signals to the re-radiating strip at a frequency of 452.9 MHz. The input of transmitter 88 is connected to microcontroller 92 and the output of transmitter 88 is connected to antenna 82.

The master unit additionally includes a power supply, such as a battery 94, for supplying power to the electronic components of the master unit. Battery 94 is preferably a 9 volt battery. A battery sensing circuit 91 for monitoring a voltage level of battery 94 has an input connected to battery 94 and an output connected to microcontroller 92. User controls 98, speaker 56, and a display driver 96 are also connected to microcontroller 92. Display driver 96 is connected to display 28. Microcontroller 92 communicates with display driver 96 via a serial bus and display driver 96 updates and refreshes display 28.

Microcontroller 92 is programmed during manufacture to perform the control functions described in the operation section below. These control functions include driving speaker 56, polling user controls 98 and the output of battery sensing circuit 91, autoprogramming each satellite unit, and managing receiver 84, switch 86, display driver 96, and transmitters 88 and 90. Microcontroller 92 is also programmed to encode and decode the search and response signals and to handle timing functions.

Microcontroller 92 has two analog inputs and is capable of converting these analog inputs to digital values internally. The first analog input is the signal strength output of RSSI circuit 85 and the second analog input is the voltage level output of battery sensing circuit 91. Microcontroller 92 also has an internal memory for storing the unique identity code of each satellite unit, a training sequence for synchronizing each satellite unit to the master unit, and a series of numbers used to calculate delay codes for timing the transmission of the search and response signals, as will be explained in the operation section below.

Figure 5:
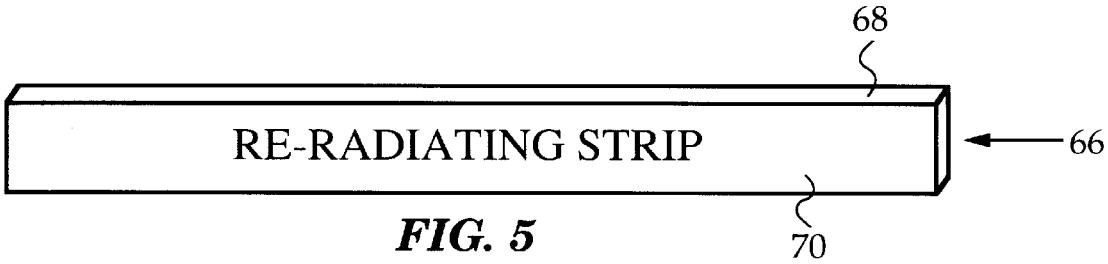
FIG. 5 is a perspective view of a re-radiating strip according to the invention.

FIG. 5 shows a re-radiating strip 66 for re-radiating radio frequency signals transmitted by the master unit. Strip 66 includes a housing 68 which is sufficiently compact to be attached to an object to be located, such as eyeglasses, a remote control unit, etc. In the preferred embodiment, housing 68 is a plastic housing having a length of 7.5 cm, a width of 0.75 cm, and a thickness of 0.075 cm. Housing 68 includes a side surface 70 designed to affix strip 66 to the object to be located. In the preferred embodiment, surface 70 is an adhesive backing for adhesively affixing strip 66 to the object. In an alternative embodiment, strip 66 is attached to the object through a loop and fastener mechanism, such as Velcro®.

Figure 6:
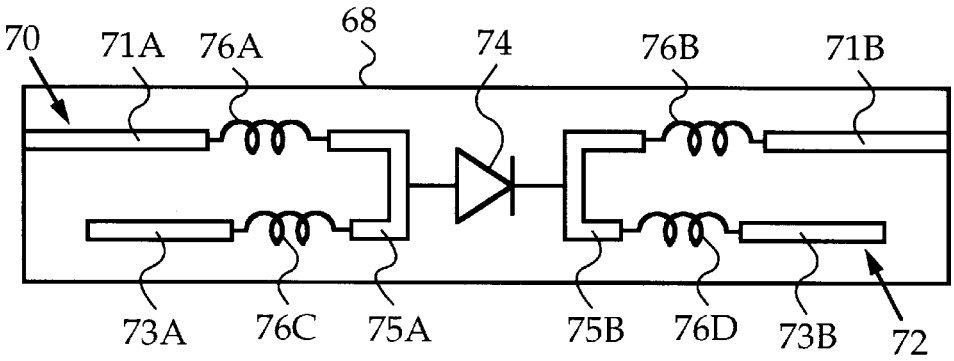
FIG. 6 is a schematic block diagram illustrating the components of the re-radiating strip of FIG. 5.

FIG. 6 illustrates the internal components of the re-radiating strip. The re-radiating strip includes a first dipole antenna 70 and a second dipole antenna 72. The dipole antennas are connected by a radio frequency diode 74. The dipole antennas and diode are preferably mounted on a printed circuit board which is encased in housing 68. Dipole antenna 70 includes two conducting elements 71A and 71B, a first inductor or coil 76A connected to element 71A and a second conductor or coil 76B connected to element 71B. Similarly, dipole antenna 72 includes two conducting elements 73A and 73B, a third inductor or coil 76C connected to element 73A and a fourth conductor or coil 76D connected to element 73B.

Both dipole antennas include common conducting elements 75A and 75B. Element 75A connects coil 76A to coil 76C and element 75B connects coil 76B to coil 76D. In the preferred embodiment, each conducting element of the re-radiating strip is an electrically conductive flat metal strip having a width in the range of 1.00 to 2.00 mm with a preferred width of 1.25 mm. Alternatively, electrically conductive wire may be used in place of the flat metal strips. Coils 76A, 76B, 76C, and 76D are presently preferred in the re-radiating strip to give each dipole antenna an electrical length longer than the physical length of housing 68. Stated another way, the coils allow the re-radiating strip to have a reduced size while still maintaining sufficient electrical lengths of the dipole antennas to perform the functions described below.

First dipole antenna 70 is tuned to receive radio frequency signals from the master unit at a fundamental frequency. Dipole antenna 70 preferably has an electrical length of $\lambda/2$, where $\lambda$ is the wavelength of the signals at the fundamental frequency. Diode 74, due to its non-linearity, creates harmonics of the radio frequency current generated by the received signals as the current flows through diode 74.

Second dipole antenna 72 is tuned to a harmonic frequency of the received signals and re-radiates the harmonic frequency of the received signals back to the master unit. In the preferred embodiment, dipole antenna 72 is tuned to the second harmonic frequency and re-radiates the second harmonic frequency of the received signals at twice the fundamental frequency. Dipole antenna 72 preferably has an electrical length of $\lambda/4$, half of the electrical length of dipole antenna 70. In the preferred embodiment, first dipole antenna 70 receives unmodulated signals at a fundamental frequency of 452.9 MHz and second dipole antenna 72 re-radiates the second harmonic frequency of the signals at twice the fundamental frequency, 905.8 MHz.

Figure 7A:
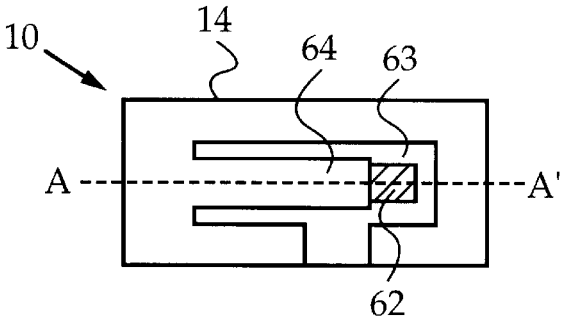
FIG. 7A is a side elevation view of the satellite unit of FIG. 1 showing a tamper proof switch locked in its ON position.
Figure 7B:
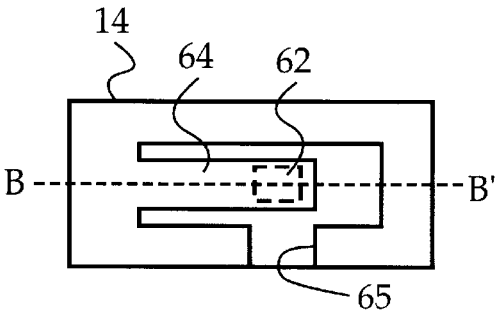
FIG. 7B is a side elevation view of the satellite unit of FIG. 1 showing a tamper proof switch locked in its OFF position.

FIG. 7A shows a side elevation view of satellite unit 10. Satellite unit 10 preferably includes a tamper-proof on/off switch for alternately connecting and disconnecting the electronic components of the satellite unit from the batteries. The switch includes a switch handle 62 located on a side surface 63 of housing 14. The switch also includes a switch latch 64. Handle 62 has a first ON position shown in FIG. 7A and a second OFF position under latch 64, as shown in FIG. 7B. Housing 14 has a groove or depression 65 molded therein to allow insertion of a pen, fingernail, or similar item for lifting latch 64.

Figure 8A:
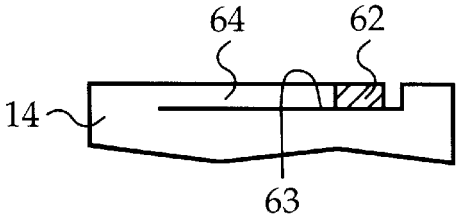
FIG. 8A is a cross sectional view of the satellite unit taken along the line 1—1' in FIG. 7A.
Figure 8B:
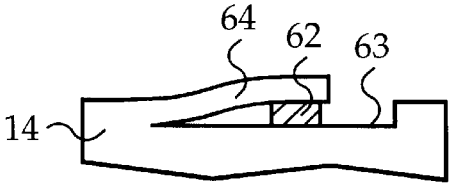
FIG. 8B is a cross sectional view of the satellite unit taken along the line 2—2' in FIG. 7B.

Referring to FIG. 8A, latch 64 has a first end attached to housing 14 and a free end. Latch 64 is preferably integral with housing 14. Alternatively, the first end of latch 62 may be hinged to housing 14. Latch 64 is attached to housing 14 such that when latch 64 is flush with surface 63, the free end locks handle 62 in its ON position. Referring to FIG. 8B, when the free end is lifted away from surface 63, handle 62 may be moved under the free end to its OFF position.

Figure 9:
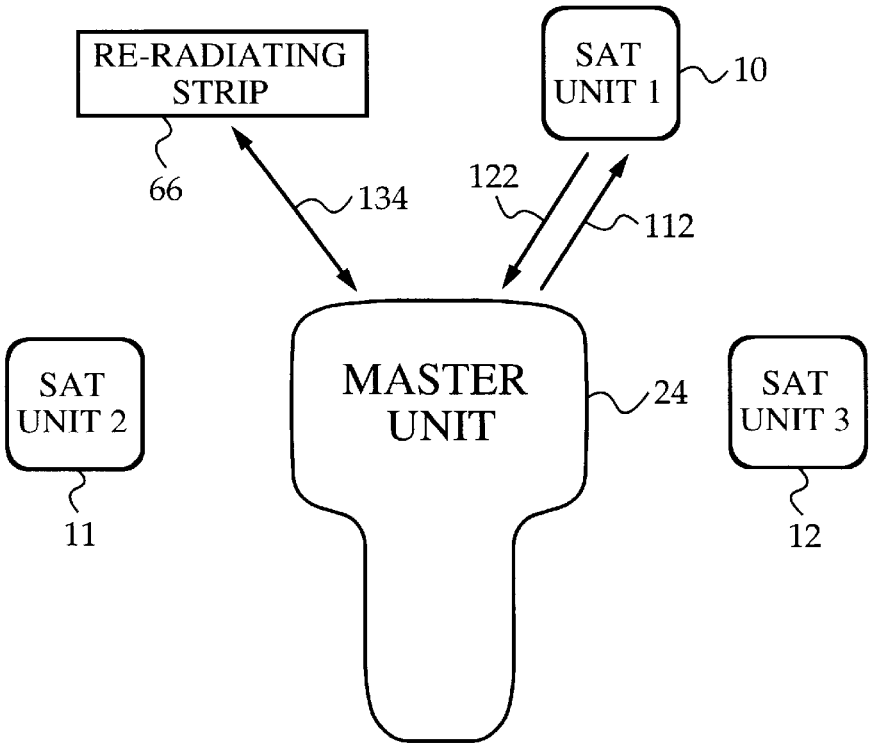
FIG. 9 is a schematic block diagram illustrating the interaction of the master unit of FIG. 2 with the satellite unit of FIG. 1 and the re-radiating strip of FIG. 5.

FIG. 9 is a schematic block diagram illustrating the interaction of master unit 24 with re-radiating strip 66, satellite unit 10, and additional satellite units 11 and 12. Satellite units 11 and 12 each have identical structure to satellite unit 10, but each satellite unit is programmed with its own unique identity code. Master unit 24 is designed to transmit a digitally coded radio frequency search signal 112 to the satellite units and an unmodulated radio frequency signal 134 to re-radiating strip 66.

Figure 10:
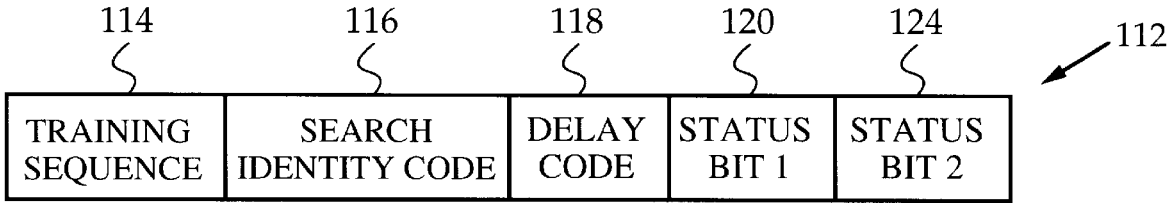
FIG. 10 is a schematic block diagram of a digitally coded radio frequency signal sent from the master unit of FIG. 2 to the satellite unit of FIG. 1.

Referring to FIG. 10, search signal 112 contains a training sequence 114, followed by a search identity code 116, a delay code 118, a first battery status bit 120, and a second battery status bit 124. Training sequence 114 is preferably an eight bit combination, e.g. 10101011. Training sequence 114 is for synchronizing each satellite unit to the master unit and for indicating to the satellite unit when search identity code 116 starts. Search identity code 116 is preferably a twenty-four bit binary coded number which matches the unique identity code of the satellite unit currently selected for location by the user. In the preferred embodiment, each unique identity code is a twenty-four bit binary coded number, so that there are over sixteen million possible combinations of identity codes.

Delay code 118 is preferably a six bit binary coded integer in the range of 1 to 63. Delay code 118 is for indicating to the selected satellite unit when the master unit will be expecting a response signal. First status bit 120 indicates a voltage status of the battery in the master unit and second status bit 124 indicates a voltage status of the batteries in the satellite unit. Status bit 124 is an echo of the last battery status bit the master unit received from the satellite unit. Thus, search signal 112 includes a total of forty bits in the preferred embodiment.

Figure 11:
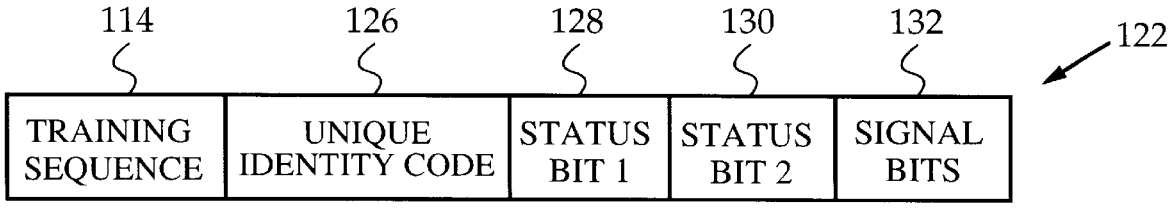
FIG. 11 is a schematic block diagram of a digitally coded radio frequency signal sent from the satellite unit of FIG. 1 to the master unit of FIG. 2.

FIG. 11 is a schematic block diagram illustrating the structure of a digitally coded radio frequency response signal 122 transmitted by the selected satellite unit to the master unit. Response signal 122 contains training sequence 114 followed by a twenty-four bit unique identity code 126 of the responding satellite unit. Response signal 122 also contains a battery status bit 128, a response button status bit 130, and signal bits 132. Status bit 128 indicates the voltage status of the batteries in the satellite unit. Status bit 130 indicates whether or not the response button is pushed. Signal bits 132 are preferably six unmodulated bits which give the master unit a continuous signal to take a signal strength reading. Thus, response signal 122 also includes a total of forty bits in the preferred embodiment.

The operation of the preferred embodiment is illustrated in FIGS. 1–11. For purposes of illustration, the operation of the master and satellite units is described in relation to a first person, the user, who controls the master unit, and a second person, the wearer, who wears the satellite unit. It is to be understood that the use of the satellite units is not limited to humans. The satellite units may also be attached to pets or inanimate objects to be tracked.

When the user wishes to search for one of the satellite units, for example satellite unit 10, he or she depresses and holds the satellite select button corresponding to the desired satellite unit. Microcontroller 92 sends a first control signal to first transmitter 90 instructing transmitter 90 to turn on and a second control signal to switch 86 instructing switch 86 to connect transmitter 90 to directional antenna 80. Microcontroller 92 then sends transmitter 90 digital data to transmit in search signal 112. The digital data includes eight bit training sequence 114, search identity code 116, delay code 118, and status bits 120 and 124.

Search identity code 116 is selected by microcontroller 92 to match the unique identity code of the selected satellite unit, in this example satellite unit 10. Delay code 118 is a pseudo-random value to avoid signal interference between two master units operating in close proximity. Microcontroller 92 selects delay code 118 from the series of numbers stored in its memory. In the preferred embodiment, the series of numbers are a series of integers 1–63 arranged in pseudorandom order, e.g. 57, 39, 26, 1, . . . , 63. For the first search signal, microcontroller 92 selects the first integer in the series. For successive search signals, microcontroller 92 selects successive integers in the series and restarts with the first integer when all of the integers in the series have been used.

Microcontroller 92 generates status bit 120 from the output of battery sensing circuit 91. Circuit 91 outputs to microcontroller 92 an analog signal indicating the voltage level of battery 94 and microcontroller 92 converts the analog signal to a digital value internally. If the digital value indicates a battery voltage below a predetermined threshold, typically 8.0V, microcontroller 92 determines a low voltage status of battery 94 and sets status bit 120 equal to 1. Otherwise, microcontroller 92 determines a normal voltage status and sets status bit 120 equal to 0.

Microcontroller 92 sets status bit 124 equal to the last battery status bit received from the selected satellite unit. Additionally, if status bit 124 indicates a low voltage status of the batteries in the selected satellite unit, microcontroller 92 instructs display driver 96 to light satellite unit battery status symbol 46 on display 28. Similarly, if status bit 120 indicates a low voltage status of the battery 94, microcontroller 92 instructs display driver 96 to light master unit battery status symbol 44 on display 28.

Transmitter 90 transmits search signal 112 through directional antenna 80 at a frequency of 916.5 MHz. While the search signal is being transmitted, microcontroller 92 instructs display driver 96 to light arrow 30 on display 28 to alert the user that the search signal is being transmitted. After the search signal is transmitted, microcontroller 92 sends a control signal to switch 86 instructing switch 86 to connect receiver 84 to directional antenna 80 so that receiver 84 may receive a response signal from the selected satellite unit.

Search signal 112 is received by receiver 102 of satellite unit 10 through antenna 18. The coded digital data in search signal 112 is output by receiver 102 to microcontroller 104. Microcontroller 104 decodes the data and compares search identity code 116 to the unique identity code stored in memory 106 to determine if the codes match. If the codes do not match, satellite unit 10 remains in continuous receive mode until it receives a search signal whose search identity code matches its unique identity code. Thus, in this example, satellite units 11 and 12 remain in continuous receive mode since search identity code 116 only matches the unique identity code of satellite unit 10.

If search identity code 116 matches the unique identity code of satellite unit 10, microcontroller 104 alerts the wearer of the satellite unit that the search signal has been received by causing LED 22 to emit a flashing signal and speaker 21 to emit an audible tone, such as a click or beep. Upon being alerted, the wearer may optionally press response button 20 to acknowledge the search signal. Microcontroller 104 is programmed to control speaker 21 and LED 22 such that the wearer is alerted only when search identity code 116 matches the unique identity code of satellite unit 10.

Further, when search signal 112 is received by receiver 102, RSSI circuit 103 indicates the signal strength of the search signal to microcontroller 104 through signal strength output 107. Microcontroller 104 is programmed to determine based on the signal strength output if the master unit is located within a predetermined threshold distance of satellite unit 10. The threshold distance is preferably in the range of 3.0 to 5.0 meters. If the master unit is located within the threshold distance, microcontroller 104 causes speaker 21 to emit a constant tone audible to the user of the master unit to assist the user in locating satellite unit 10.

After search signal 112 has been received, microcontroller 104 calculates a delay period from delay code 118. The delay period is a period of time the satellite unit delays before transmitting response signal 122 to master unit 24. In the preferred embodiment, microcontroller 104 calculates the delay period by multiplying delay code 118 by the time it took to read the forty bits of search signal 112. The data rate is typically 4,000 bits per second so that each cycle of forty bits takes 10 mS to read.

Delay code 118 is never zero so that the satellite unit will always have at least one inactive cycle after a receive cycle to process the data received and prepare for the next receive cycle. If either battery status bit indicates a low voltage status of the batteries in master unit 24 or satellite unit 10, the delay period is further multiplied by four. This reduces how often the master and satellite units must transmit, thus conserving power.

After calculating the delay period, microcontroller 104 sends a first control signal to transmitter 100 instructing transmitter 100 to turn on and a second control signal to switch 101 instructing switch 101 to connect transmitter 100 to antenna 18. Microcontroller 104 then sends transmitter 100 digital data to transmit in response signal 122. The response signal includes sequence 114, unique identity code 126, status bits 128 and 130, and signal bits 126.

To send the digital data to transmitter 100, microcontroller 104 retrieves eight bit training sequence 114 and unique identity code 126 from memory 106. Microcontroller 104 also generates status bit 128 from the output of battery sensing circuit 109. Status bit 128 indicates the voltage status of batteries 108. Circuit 109 outputs to microcontroller 104 an analog signal indicating the voltage level of batteries 108 and microcontroller 104 converts the analog signal to a digital value internally.

If the digital value indicates a combined battery voltage level below a predetermined threshold, typically 2.5V, microcontroller 104 determines a low voltage status and sets status bit 128 equal to 1. Otherwise, microcontroller 104 determines a normal voltage status and sets status bit 128 equal to 0. Second status bit 130 indicates whether response button 20 is pushed. Microcontroller 104 sets second status bit 130 equal to 1 if response button 20 is pushed and to 0 if response button 20 is not pushed.

At the end of the delay period, microcontroller 104 causes transmitter 100 to transmit response signal 122 through antenna 18 at a frequency of 905.8 MHz. After the response signal is transmitted, microcontroller 104 sends a control signal to switch 101 instructing switch 101 to connect receiver 102 to antenna 18 so that receiver 102 may receive another search signal from master unit 24.

Response signal 122 is received by receiver 84 of the master unit through directional antenna 80. While the response signal is being received, microcontroller 92 instructs display driver 96 to light arrow 32 on display 28 to alert the user that the response signal is being received. The coded digital data in response signal 122 is output by receiver 84 to microcontroller 92.

Microcontroller 92 decodes the data and compares unique identity code 126 to the search identity code last transmitted in search signal 112 to determine if the codes match. If the codes do not match, master unit 24 continues to transmit search signals until receiving a response signal whose unique identity code matches the search identity code last transmitted or until the user stops the search by releasing the satellite select button. In the preferred embodiment, master unit 24 only indicates the strength of each response signal to the user when the unique identity code in the response signal matches the search identity code last transmitted by the master unit.

If unique identity code 126 matches the search identity code last transmitted by the master unit, the master unit determines the signal strength of the response signal and visually and audibly indicates the signal strength to the user, as will be explained in detail below. Additionally, if status bit 128 indicates a low voltage status of the batteries in the selected satellite unit, microcontroller 92 instructs display driver 96 to light satellite unit battery status symbol 46 on display 28. Similarly, if status bit 130 indicates that response button 20 of the selected satellite unit has been pushed, microcontroller 92 instructs display driver 96 to light response button symbol 48 on display 28.

Master unit 24 then waits an amount of time equal to the delay period calculated from the last transmitted delay code and transmits to the selected satellite unit another digitally coded radio frequency signal containing a new delay code. This cycle of transmitting search signals and receiving response signals continues until the user stops the search by releasing the satellite select button. If at any point during the search the selected satellite unit does not receive a search signal from the master unit when expected, the satellite unit resets to the mode of continuously receiving so that it can re-synchronize with the master unit.

After each response signal is received from the selected satellite unit, master unit 24 visually indicates the strength of the response signal to the user through bar graph 34 on display 28. The number of bars lit on graph 34 indicates the strength of the signal. Master unit 24 also audibly indicates the strength of the response signals to the user by driving speaker 56 to emit audible tones at a variable tone rate. The tone rate indicates the strength of the response signals.

To indicate the strength of the response signals, the signal strength of each response signal is first determined by RSSI circuit 85. RSSI circuit 85 outputs to microcontroller 92 an analog voltage signal indicative of the signal strength. In the preferred embodiment, circuit 85 outputs an analog voltage signal which varies linearly with the signal strength from a minimum value of 0.00V for a signal strength of −120 dBm to a maximum value of 3.00V for a signal strength of −30 dBm. Microcontroller 92 receives the analog voltage signal from circuit 85 and converts the analog signal to a digital voltage value internally.

Microcontroller 92 instructs display driver 96 to light a number of bars 36 of graph 34 in dependence upon the digital voltage value and current resolution range selected by the user. Also in dependence upon the digital voltage value and current resolution range selected, microcontroller 92 drives speaker 56 to emit audible tones at a tone rate which varies with the strength of the received signals. Preferred values for the number of lit bars and tone rates for corresponding ranges of voltages are illustrated in Tables 1–3. Table 1 shows the preferred values when long range resolution is selected. Table 2 shows the preferred values when mid-range resolution is selected. Table 3 shows the preferred values when short range resolution is selected.

TABLE 1

| Long Range | | |
|---|---|---|
| Voltage Value | Number of Bars Lit | Tones per Second |
| 0.00 Volts | 0 | 0 |
| 0.01–0.15 Volts | 1 | 1 |
| 0.16–0.30 Volts | 2 | 2 |
| 0.31–0.45 Volts | 3 | 3 |
| 0.46–0.60 Volts | 4 | 4 |

TABLE 1-continued

| Long Range | | |
|---|---|---|
| Voltage Value | Number of Bars Lit | Tones per Second |
| 0.61–0.75 Volts | 5 | 5 |
| 0.76–0.90 Volts | 6 | 6 |
| 0.91–1.05 Volts | 7 | 7 |
| 1.06–1.20 Volts | 8 | 8 |
| 1.21–1.35 Volts | 9 | 9 |
| 1.36–3.00 Volts | 10 | 10 |

TABLE 2

| Mid-Range | | |
|---|---|---|
| Voltage Value | Number of Bars Lit | Tones per Second |
| 0.00–0.74 Volts | 0 | 0 |
| 0.75–0.90 Volts | 1 | 1 |
| 0.91–1.05 Volts | 2 | 2 |
| 1.06–1.20 Volts | 3 | 3 |
| 1.21–1.35 Volts | 4 | 4 |
| 1.36–1.50 Volts | 5 | 5 |
| 1.51–1.65 Volts | 6 | 6 |
| 1.80–1.95 Volts | 7 | 7 |
| 1.96–2.10 Volts | 8 | 8 |
| 2.15–2.30 Volts | 9 | 9 |
| 2.31–3.00 Volts | 10 | 10 |

TABLE 3

| Short Range | | |
|---|---|---|
| Voltage Value | Number of Bars Lit | Tones per Second |
| 0.00–1.49 Volts | 0 | 0 |
| 1.50–1.65 Volts | 1 | 1 |
| 1.66–1.80 Volts | 2 | 2 |
| 1.81–1.95 Volts | 3 | 3 |
| 1.96–2.10 Volts | 4 | 4 |
| 2.11–2.25 Volts | 5 | 5 |
| 2.26–2.40 Volts | 6 | 6 |
| 2.41–2.55 Volts | 7 | 7 |
| 2.56–2.70 Volts | 8 | 8 |
| 2.71–2.85 Volts | 9 | 9 |
| 2.86–3.00 Volts | 10 | 10 |

The values shown in Tables 1–3 are exemplary of the preferred embodiment and are not intended to limit the scope of the invention. It is obvious that different values for the number of lit bars and tone rates for corresponding signal strengths may be used in alternative embodiments.

To determine the direction and approximate distance from master unit 24 to satellite unit 10, the user depresses and holds the corresponding satellite select button while slowly rotating master unit 24 in a circle. Because antenna 80 of the master unit is directional, pointing master unit 24 towards satellite unit 10 results in stronger signal indications than pointing master unit 24 away from satellite unit 10. As master unit 24 is rotated, the number of bars lit on graph 34 and the tone rate of speaker 56 vary with the strength of the received signals.

The user rotates master unit 24 until determining the orientation of the master unit in which the largest signal strength indications are received. The direction in which master unit 24 is pointing in this orientation, e.g. the direction of up arrow 30, is the direction to satellite unit 10. The number of bars lit on graph 34 and tone rate of speaker 56 also indicate an approximate distance to satellite unit 10.

If during the search an insufficient number of bars are lit to assess the orientation of master unit 24 in which the largest signal strength is received, the user presses range control button 52 to toggle to a longer range. Similarly, if during the search too many bars are lit for the user to determine the orientation of the master unit in which the largest signal strength is received, the user presses range control button 52 to select a shorter range. In the preferred embodiment, master unit 24 has a maximum range of about 310 meters for receiving response signals from the satellite units.

Each satellite unit is preferably programmed with a unique identity code as follows. During manufacture, master unit 24 is programmed with a first unique identity code. Master unit 24 uses this first unique identity code to autoprogram a first satellite unit, such as satellite unit 10. Master unit 24 autoprograms additional satellite units with unique identity codes which microcontroller 92 generates sequentially from the first unique identity code.

The first satellite unit, satellite unit 10 in this example, is autoprogrammed in the following manner. When batteries 108 are first installed in satellite unit 10 and on/off switch handle 64 is placed in its ON position, microcontroller 104 causes LED 22 to flash and speaker 21 to emit a series of audible tones, alerting the user that satellite unit 10 is in a non-programmed state and needs to be programmed. The user points master unit 24 at satellite unit 10 and depresses one of the six satellite select buttons. When the satellite select button is depressed, master unit 24 transmits to satellite unit 10 a search signal having a search identity code which is the first unique identity code.

Receiver 102 of satellite unit 10 receives the search signal through antenna 18. RSSI circuit 103 indicates the signal strength of the received signal to microcontroller 104 through signal strength output 107. To prevent satellite unit 10 from being accidentally autoprogrammed by another master unit operating farther away, microcontroller 104 is preprogrammed to accept the unique identity code in the signal only if the signal strength is above a predetermined threshold. In the preferred embodiment, master unit 24 must be located within three feet of satellite unit 10 for the signal strength to exceed the threshold.

If the signal strength is above the threshold, microcontroller 104 decodes the signal and stores the unique identity code in non-volatile memory 106. Memory 106 will now continue to store the unique identity code even if batteries 108 are removed. Each additional satellite unit is autoprogrammed in a similar manner, with the user selecting a different satellite select button for each satellite unit. Each satellite unit preferably includes an internal push-button switch which is pushed to reset the unit to its non-programmed state if the user wants to change the unit's unique identity code.

To use re-radiating strip 66, the user first attaches strip 66 to an object to be tracked. When the user wishes to search for re-radiating strip 66, he or she depresses and holds strip select button 58 of master unit 24.

Microcontroller 92 instructs second transmitter 88 to transmit a radio frequency signal 134 through antenna 82. In the preferred embodiment, signal 134 is an unmodulated signal transmitted at a frequency of 452.9 MHz. While signal 134 is being transmitted, microcontroller 92 instructs display driver 96 to light arrow 30 on display 28 to alert the user that the signal is being transmitted.

First dipole antenna 70 of strip 66 receives signal 134 at its fundamental frequency of 452.9 MHz and second dipole antenna 72 re-radiates the second harmonic of signal 134 at twice the fundamental frequency, 905.8 MHz. This is the same frequency at which receiver 84 of master unit 24 receives response signals from the satellite units, allowing master unit 24 to use the same directional antenna and receiver to locate re-radiating strip 66. The re-radiated signal is received by receiver 84 through directional antenna 80. While the re-radiated signal is being received, microcontroller 92 instructs display driver 96 to light arrow 32 on display 28 to alert the user that the signal is being received.

Master unit 24 continues the cycle of transmitting signals and receiving re-radiated signals until the user stops the search by releasing strip select button 58. Master unit 24 measures the signal strength of each re-radiated signal and visually and audibly indicates the signal strength to the user, as was previously described in relation to response signals. In the preferred embodiment, master unit 24 and re-radiating strip 66 operate at a maximum range of about 10 meters. The remaining operation of master unit 24 to locate re-radiating strip 66 is analogous to the previously described operation of master unit 24 to locate satellite unit 10.

One advantage of the tracking system of the present invention is that it allows multiple satellite units to be selectively and individually located by the master unit without producing signal interference. A second advantage of the tracking system is that the master and satellite units consume a reduced amount of power since the units only transmit signals when they are involved in a search. A third advantage of the tracking system is that it allows conveniently small and inexpensive re-radiating strips to be substituted for the satellite units for close proximity applications.

Although the preferred embodiment of the tracking system includes both satellite units and re-radiating strips, a second embodiment of the invention eliminates the re-radiating strips so that the tracking system includes only the master and satellite units. The advantage of eliminating the re-radiating strips is that it simplifies the manufacture of the master unit, hence reducing its cost. Referring to FIG. 4, the master unit is simplified in the second embodiment by eliminating second antenna 82 and second transmitter 88. Referring to FIG. 2, strip select button 58 may also be eliminated or converted to a seventh satellite select button.

Similarly, a third embodiment of the invention eliminates the satellite units so that the tracking system includes only the master unit and re-radiating strips. As is the case with the second embodiment, the advantage of the third embodiment is that it simplifies the manufacture of the master unit and reduces the cost of the tracking system. Referring to FIG. 4, the master unit is simplified in the third embodiment by eliminating first transmitter 90 and switch 86. Referring to FIG. 2, satellite select buttons 54, satellite unit battery status symbol 46, and response button symbol 48 are also eliminated in the third embodiment.

SUMMARY, RAMIFICATIONS, AND SCOPE

Although the above description contains many specificities, these should not be construed as limitations on the scope of the invention, but merely as illustrations of the presently preferred embodiment. Many other embodiments of the invention are possible. For example, the specific frequencies of the signals transmitted and received by the master and satellite units and of the signals re-radiated by the re-radiating strip may be varied in alternative embodiments. The particular frequencies used should be selected to comply with FCC regulations.

It is presently preferred to transmit radio frequency signals to the re-radiating strip at a fundamental frequency which is half the frequency of the response signals transmitted by the satellite units. This allows the master unit to use the same receiving equipment to receive both the response signals and re-radiated signals. However, in an alternative embodiment, a second receiver may be employed in the master unit to obviate this requirement. Alternatively, the re-radiating strip may be tuned to re-radiate any multiple of the fundamental frequency.

Additionally, the number of satellite units and re-radiating strips used in the tracking system may vary in alternative embodiments. For simplicity of understanding, the preferred embodiment is described with reference to three satellite units and one re-radiating strip. However, it is anticipated that the tracking system may employ as many as 256 satellite units and an unlimited number of re-radiating strips. It is obvious to one skilled in the art to add additional user controls, such as a keypad, to enable user selection of a greater number of satellite units.

Similarly, it is obvious to one skilled in the art to vary the transmitters and receivers of the master and satellite units to increase or decrease the operating range of the units as desired. Further, the signal strength of response signals received by the master unit may be indicated to the user in many different ways. The preferred values for the number of bars lit and rate of tones emitted are exemplary of preferred embodiment and may be changed as desired in alternative embodiments. Also, the specific display symbols used and size and shape of the master and satellite units may be varied in alternative embodiments.

Therefore, the scope of the invention should be determined not by the examples given, but by the appended claims and their legal equivalents.

What is claimed is:

1. A tracking system comprising:

a) a satellite unit having:

i) first memory means for storing a unique identity code of the satellite unit;

ii) first receiving means for receiving a coded radio frequency search signal;

iii) first transmitting means for transmitting a coded radio frequency response signal, wherein the search signal includes a search identity code and a pseudo-random delay code, and wherein the response signal includes the unique identity code of the satellite unit;

iv) first control means connected to the first memory means, the first receiving means, and the first transmitting means for decoding the search signal, for determining whether the search identity code matches the unique identity code, for calculating a delay period from the delay code, and for controlling the first transmitting means such that the first transmitting means transmits the response signal at the end of the delay period only when the search identity code matches the unique identity code; and b) a master unit having:

i) user controls for selecting the satellite unit to be located;

ii) second memory means for storing the unique identity code of the satellite unit and a series of numbers from which to select the delay code;

iii) second transmitting means for transmitting the search signal;

iv) second receiving means for receiving the response signal, wherein the second receiving means includes signal strength means for determining a strength of the response signal;

v) second control means connected to the user controls, the second memory means, the second transmitting means, and the second receiving means for selecting the delay code from the series of numbers and for controlling the second transmitting means such that when a user of the master unit selects the satellite unit to be located, the second transmitting means transmits the search signal with the selected delay code and with the search identity code matching the unique identity code of the satellite unit; and vi) indicator means connected to the signal strength means for indicating to the user the strength of the response signal, wherein the second receiving means comprises a directional antenna oriented in the master unit such that the response signal received by the master unit is strongest when the master unit is pointed directly at the satellite unit.

2. The tracking system of claim 1, wherein the master unit further has a third transmitting means connected to the second control means for transmitting a third radio frequency signal, the tracking system further comprises a re-radiating strip for re-radiating the third signal such that the re-radiated signal is received by the second receiving means, the signal strength means further includes means for determining a strength of the re-radiated signal, the user controls further include strip control means for instructing the master unit to transmit the third signal, the second control means includes means for controlling the third transmitting means such that the third transmitting means transmits the third signal when the user activates the strip control means, and the indicator means includes means for indicating to the user the strength of the re-radiated signal.

3. The tracking system of claim 2, wherein the re-radiating strip comprises a first dipole antenna for receiving the third signal from the master unit at a fundamental frequency and a second dipole antenna connected to the first dipole antenna for re-radiating a second harmonic of the third signal at a second frequency substantially equal to twice the fundamental frequency.

4. The tracking system of claim 3, wherein the first dipole antenna has a first electrical length substantially equal to one half of the wavelength of the third signal at the fundamental frequency and the second dipole antenna has a second electrical length substantially equal to one fourth of the wavelength of the third signal at the fundamental frequency.

5. The tracking system of claim 3, wherein the first transmitting means of the satellite unit is adapted to transmit the response signal at a third frequency substantially equal to the second frequency.

6. The tracking system of claim 2, wherein the re-radiating strip includes a housing having an adhesive backing for affixing the strip to an object to be located.

7. The tracking system of claim 1, wherein the indicator means comprises a visual indicator means for visually indicating the strength of the response signal.

8. The tracking system of claim 7, wherein the visual indicator means comprises a bar graph display means for displaying a bar graph having a plurality of individually lightable bars, and wherein the number of lit bars indicates the strength of the response signal.

9. The tracking system of claim 1, wherein the indicator means comprises an audible indicator means for audibly indicating the strength of the response signal.

10. The tracking system of claim 9, wherein the audible indicator means comprises an audio transducer means for emitting tones at a variable tone rate, and wherein the tone rate indicates the strength of the response signal.

11. The tracking system of claim 1, wherein the indicator means has a plurality of resolution ranges, the master unit further includes user range control means connected to the indicator means for selecting any one of the resolution ranges, and the indicator means further includes means for indicating the strength of the response signal in dependence upon the resolution range selected.

12. The tracking system of claim 1, wherein the second control means includes additional control means for decoding the response signal, for determining whether the unique identity code matches the search identity code last transmitted by the master unit, and for controlling the indicator means such that the indicator means only indicates the strength of the response signal to the user when the unique identity code matches the search identity code last transmitted by the master unit.

13. The tracking system of claim 1, wherein the satellite unit further includes a housing and a fastener attached to the housing for securing the satellite unit to a wearer, and wherein the first receiving means comprises an antenna integrated with the fastener.

14. The tracking system of claim 1, wherein the satellite unit further includes an alert means connected to the first control means for alerting a wearer of the satellite unit that the search signal has been received, and wherein the first control means includes means for controlling the alert means such that the alert means alerts the wearer only when the search identity code matches the unique identity code.

15. The tracking system of claim 14, wherein the alert means comprises a visual alert means for emitting a flashing signal.

16. The tracking system of claim 14, wherein the alert means comprises an audible alert means for emitting an audible tone.

17. The tracking system of claim 1, wherein the satellite unit further includes a response button connected to the first control means, the response signal further includes a status bit indicating whether the response button has been pushed, and the master unit further includes response button indication means connected to the second control means for indicating to the user that the response button has been pushed.

18. The tracking system of claim 1, wherein the satellite unit further includes a power supply and a sensing means connected to the power supply and the first control means for monitoring a voltage level of the power supply, the response signal further includes a status bit indicating a voltage status of the power supply, and the master unit further includes low power supply indication means connected to the second control means for indicating to the user that the power supply has a low voltage status.

19. The tracking system of claim 1, wherein the satellite further comprises a housing, a power supply, and a tamper proof on/off switch for alternately connecting and disconnecting the power supply from the first receiving means, the first transmitting means, and the first control means, the switch comprising a switch handle and a latch, the switch handle being located on an outside surface of the housing and having first and second positions thereon, the latch having a first end attached to the housing and a free end, and the latch being attached to the housing such that when the latch is substantially flush with the outside surface, the free end locks the switch handle in the first position and such that when the free end is lifted away from the outside surface, the switch handle may be moved under the free end to the second position.

20. The tracking system of claim 1, wherein the master unit further includes a power supply, a sensing means connected to the power supply and the second control means for monitoring a voltage level of the power supply, and a low power supply indication means connected to the second control means for indicating to the user that the power supply has a low voltage status.

21. A tracking system comprising:

a) a re-radiating strip for re-radiating a radio frequency search signal; and b) a master unit having a transmitting means for transmitting said search signal, a user control means for instructing said master unit to transmit said search signal, and a receiving means for receiving the re-radiated signal from said strip, said receiving means including a signal strength means for determining a strength of the re-radiated signal, said master unit also having a second control means connected to said user control means, said transmitting means, and said receiving means for controlling said transmitting means such that said transmitting means transmits said search signal when a user of said master unit activates said user control means, and said master unit further having an indicator means connected to said signal strength means for indicating to the user the strength of the re-radiated signal.

22. The tracking system of claim 21, wherein said re-radiating strip comprises a first dipole antenna for receiving said search signal from said master unit at a fundamental frequency and a second dipole antenna connected to said first dipole antenna for re-radiating a second harmonic of said search signal at a second frequency substantially equal to twice the fundamental frequency.

23. The tracking system of claim 22, wherein said first dipole antenna has a first electrical length substantially equal to one half of the wavelength of said search signal at said fundamental frequency and said second dipole antenna has a second electrical length substantially equal to one fourth of the wavelength of said search signal at said fundamental frequency.

24. The tracking system of claim 21, wherein said re-radiating strip includes a housing having an adhesive backing for adhesively affixing said strip to an object to be located.

25. The tracking system of claim 21, wherein said receiving means comprises a directional antenna oriented in said master unit such that the re-radiated signal received by said master unit is strongest when said master unit is pointed directly at said strip.

26. The tracking system of claim 21, wherein said indicator means comprises a visual indicator means for visually indicating the strength of the re-radiated signal.

27. The tracking system of claim 26, wherein said visual indicator means comprises a bar graph display means for displaying a bar graph having a plurality of individually lightable bars, and wherein the number of lit bars indicates the strength of the re-radiated signal.

28. The tracking system of claim 21, wherein said indicator means comprises an audible indicator means for audibly indicating the strength of the re-radiated signal.

29. The tracking system of claim 28, wherein said audible indicator means comprises an audio transducer means for emitting tones at a variable tone rate, and wherein the tone rate indicates the strength of the re-radiated signal.

30. The tracking system of claim 21, wherein said indicator means has a plurality of resolution ranges, said master unit further includes user range control means connected to said indicator means for selecting any one of said resolution ranges, and said indicator means further includes means for indicating the strength of the re-radiated signal in dependence upon the resolution range selected.

31. The tracking system of claim 21, wherein said master unit further includes a power supply, a sensing means connected to said power supply and said second control means for monitoring a voltage level of said power supply, and a low power supply indication means connected to said second control means for indicating to the user that said power supply has a low voltage status.

* * * * *